US011305969B2

(12) United States Patent
Niemelä et al.

(10) Patent No.: US 11,305,969 B2
(45) Date of Patent: Apr. 19, 2022

(54) CONTROL OF OVERHEAD CRANES

(71) Applicant: ABB Schweiz AG, Baden (CH)

(72) Inventors: Matias Niemelä, Helsinki (FI); Michael Rodas, Espoo (FI); Juri Voloshkin, Helsinki (FI)

(73) Assignee: ABB Schweiz AG, Baden (CH)

( * ) Notice: Subject to any disclaimer, the term of this patent is extended or adjusted under 35 U.S.C. 154(b) by 286 days.

(21) Appl. No.: 16/410,257

(22) Filed: May 13, 2019

(65) Prior Publication Data

US 2019/0345007 A1 Nov. 14, 2019

(30) Foreign Application Priority Data

May 11, 2018 (EP) ..... 18171776

(51) Int. Cl.
*B66C 13/06* (2006.01)
*B66C 13/22* (2006.01)
*B66C 13/48* (2006.01)

(52) U.S. Cl.
CPC ..... *B66C 13/063* (2013.01); *B66C 13/22* (2013.01); *B66C 13/48* (2013.01); *B66C 2700/012* (2013.01); *B66C 2700/084* (2013.01)

(58) Field of Classification Search
CPC ..... B66C 13/063; B66C 13/06; B66C 13/18; B66C 13/22; B66C 13/48; B66C 2700/012; B66C 2700/084
See application file for complete search history.

(56) References Cited

U.S. PATENT DOCUMENTS 7,426,423 B2 9/2008 Schneider et al.
7,627,393 B2 12/2009 Sawodny et al.
(Continued)

FOREIGN PATENT DOCUMENTS

CN 106365043 A 2/2017
DE 19907989 A1 10/1999
(Continued)

OTHER PUBLICATIONS

Office Action from Chinese Appln. No. 201910383951.4, 7 pgs., Jun. 2, 2020. 2020.
(Continued)

*Primary Examiner* — Michael E Gallion
(74) *Attorney, Agent, or Firm* — Leydig, Voit & Mayer, Ltd.

(57) ABSTRACT

A method of positioning a movable structure of an overhead crane, the movable structure being either a trolley or a bridge of the overhead crane, the method comprising providing a position reference for the movable structure, controlling with a state-feedback controller the position of the movable structure, the position of the movable structure and a sway angle of the load being state variables of the system used in the state-feedback controller. Further the method comprises determining the position or speed of the movable structure and the sway angle of the load or angular velocity of the load, providing the determined position or speed of the movable structure, the determined sway angle of the load or angular velocity of the load and the output of the state-feedback controller to an observer, producing with the observer at least two estimated state variables, forming a feedback vector from the estimated state variables or from the estimated state variables together with determined state variables, using the formed feedback vector as a feedback for the state-feedback controller, and providing the output of the controller to a frequency converter.

17 Claims, 7 Drawing Sheets

(56) References Cited

U.S. PATENT DOCUMENTS

| | | | | |
|---|---|---|---|---|
| 8,504,253 | B2 * | 8/2013 | Stantchev | B66C 13/063 701/50 |
| 9,108,826 | B2 * | 8/2015 | Eriksson | B66C 13/46 |
| 9,556,006 | B2 | 1/2017 | Schneider et al. | |

FOREIGN PATENT DOCUMENTS

| | | | |
|---|---|---|---|
| DE | 102014008094 | A1 | 12/2015 |
| EP | 2103760 | A2 | 9/2009 |
| EP | 2103760 | A3 | 4/2010 |
| EP | 2562125 | A1 | 2/2013 |
| EP | 2821359 | A1 | 1/2015 |
| JP | 2012111561 | A | 6/2012 |
| WO | 0232805 | A1 | 4/2002 |
| WO | 02070388 | A1 | 9/2002 |
| WO | 2004106215 | A1 | 12/2004 |

OTHER PUBLICATIONS

Chunyan, Yang "Anti-Swing and Position Control for Bridge Cranes Based RBF Nueral Network", Beijing University of chemical technology, Institute of Information Science and Technology, Feb. 24, 2011, 5 pgs. 2011.

European Patent Office, Extended Search Report issued in corresponding Application No. 18171776.0, dated Oct. 26, 2018, 14 pp.

* cited by examiner

CONTROL OF OVERHEAD CRANES

FIELD OF THE INVENTION

The invention relates to control of overhead cranes, and particularly to swayless control of an overhead crane using a frequency converter.

BACKGROUND OF THE INVENTION

Overhead cranes are widely used for material handling in many industrial areas, including factories, steelworks and harbors. An overhead crane contains a trolley, which moves on rails along a horizontal plane. The rails on which the trolley moves are attached to a bridge which is also a movable structure. FIG. 1 shows a typical overhead crane. The payload is connected to the trolley with a cable which length varies when hoisting the payload.

There are two directions of motion known as the trolley and the long-travel movement as shown in FIG. 1. As overhead cranes are flexible in nature, the payload tends to oscillate when moving the load or as a result of external disturbances such as wind. Naturally, these uncontrolled oscillations cause safety hazards and make the transportation and unloading of loads problematic. Since extremely light damping is characteristic for overhead cranes, the accurate positioning of the load is difficult and thereby reduces productivity. In order to compensate the large payload oscillations induced by commanded motions, automatic sway controllers, often referred to as "anti-sway" controllers, have been developed. The task of the anti-sway controller is to eliminate the residual swaying of the load and thereby enable faster transportation of the load. The aforementioned crane function is often referred to as "swayless" crane control.

An anti-sway controller can be designed for speed and position control modes. A speed controlled crane follows a given speed reference whereas in the position control mode the crane moves to a given reference position. As many industrial processes and operations are becoming more and more automated and intelligent, the interest for fully-automated cranes is growing as well. Such cranes require point-to-point positioning and, hence, the anti-sway position control mode.

A swayless position controller for an overhead crane can be implemented with open-loop and closed-loop methods. However, since open-loop control is based on anticipatory suppression of oscillations by modifying a reference command, it cannot compensate initial swaying of the load nor oscillations caused by external disturbances such as wind. A traditional approach for solving the aforementioned problems is combining open-loop methods such as command shaping with closed-loop feedback control. As external disturbances such as wind mainly effect only the movement of the payload, a sway angle or sway velocity measurement is needed for feedback to maximize robustness against such disturbances. Additionally, the position or speed of the movable structure, such as the trolley or the bridge, is typically measured in order to enhance positioning accuracy. The sway angle measurement is, however, noisy. Even though the sensor technologies for measuring the sway angle are slowly developing, the implementation of a precise, low cost and noise-free sway angle measurement is difficult.

Multiple closed-loop control schemes are presented in the literature, which utilize the sway angle measurement. Commonly closed-loop anti-sway methods use linear control theory in the feedback-loop design. A typical approach is using separate P/PD/PI/PID compensators for controlling the position/speed of the movable structure and the swaying of the load, respectively. However, implementing the feedback controller by combining separate controllers can be complicated and lead to undesired positioning dynamics, like overshoot. Moreover, using a separate PD/PI/PID controller for controlling the sway angle does not consider sway angle measurement noise.

It is thus desirable to develop a swayless position controller for an overhead crane, which enables precise and smooth positioning without any residual swaying even in windy conditions.

BRIEF DESCRIPTION OF THE INVENTION

An object of the present invention is to provide a method and an arrangement for implementing the method so as to overcome the above problems. The objects of the invention are achieved by a method and an arrangement which are characterized by what is stated in the independent claims. The preferred embodiments of the invention are disclosed in the dependent claims.

The invention is based on the idea of using a model-based control method in controlling the position of an overhead crane. In the model-based control method, such as state-space control, a physical model of the overhead crane is employed. With a state-space controller, both the position of the movable structure as well as the sway angle of the load can be controlled with a single feedback vector.

The use of state-space control gives freedom to place all the closed-loop poles as desired. In state-space control a high number of sensors is needed to measure all the states of the system. However, the number of sensors needed can be reduced by using estimates for some of the state variables. In the invention, another dynamical system called the observer or estimator is employed. The observer is used to produce estimates of the state variables of the original system, for which there are no measurements. Further, according to an alternative an observer employed filter out measurement noise and thereby increase the robustness of the control system. The signal from the sway angle measurement can also be low-pass filtered before the measurement signal is fed to an observer. The measurement noise is preferably filtered out from feedback signals like the sway angle measurement.

An advantage of the method and arrangement of the invention is that the overhead crane can be controlled to a desired position without residual sway of the load even when disturbances, such as wind, influence on the load of the crane.

BRIEF DESCRIPTION OF THE DRAWINGS

In the following the invention will be described in greater detail by means of preferred embodiments with reference to the attached drawings, in which.

DETAILED DESCRIPTION OF THE INVENTION

In the following, it is described in detail, how an observer-based state-space control is structured for swayless control of overhead cranes. Since state-space control is a model-based control method, a physical model of an overhead crane is derived from its equations of motion and presented in state-space form. Further, the effects of wind disturbances acting on the crane pendulum are modelled and the state-space control and state observer design for the swayless position controller of the invention is presented. In the following description, the state-space control is described in connection with a trolley of an overhead crane. However, the invention relates to control of a movable structure of an overhead crane. The movable structure can be either the trolley of the crane or the bridge of the crane. In an overhead crane typically the movement of both the trolley and the bridge are controlled. Thus the crane comprises two separate controllers, one for controlling the trolley and another for controlling the bridge.

According to an embodiment a motion profile generator is combined with the observer-based state-space controller to form a two-degree-of-freedom (2DOF) control structure. In addition, different embodiments for integrating the swayless position controller with the actuator by utilizing the internal control loops of a variable speed drive are discussed.

Figure 1:
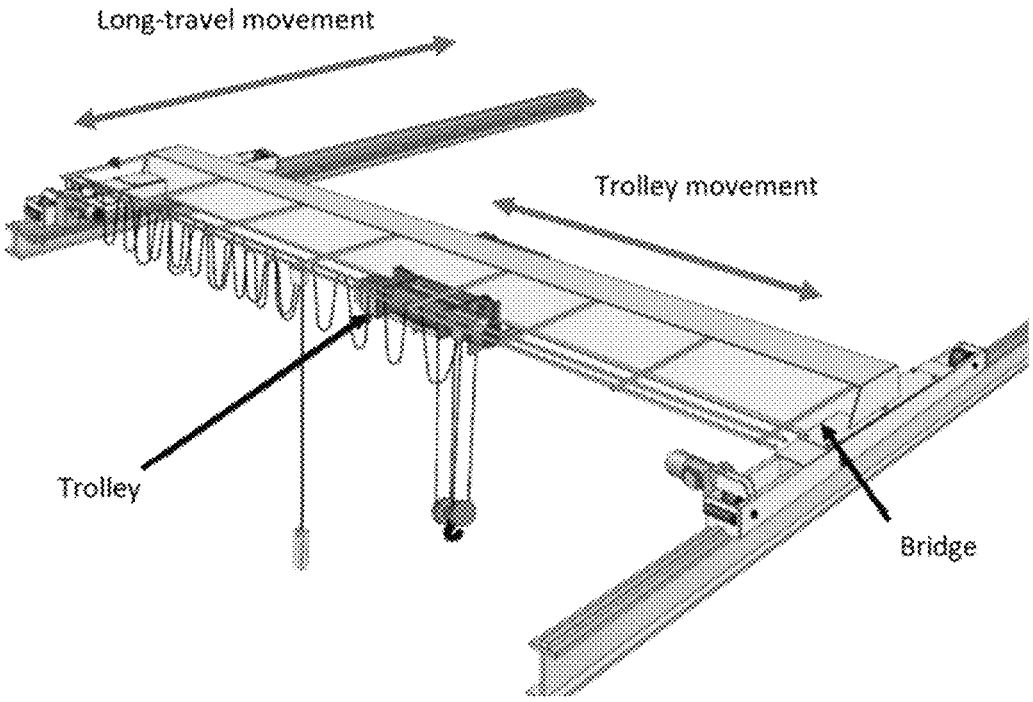
FIG. 1 shows an example of an overhead crane.
Figure 2:
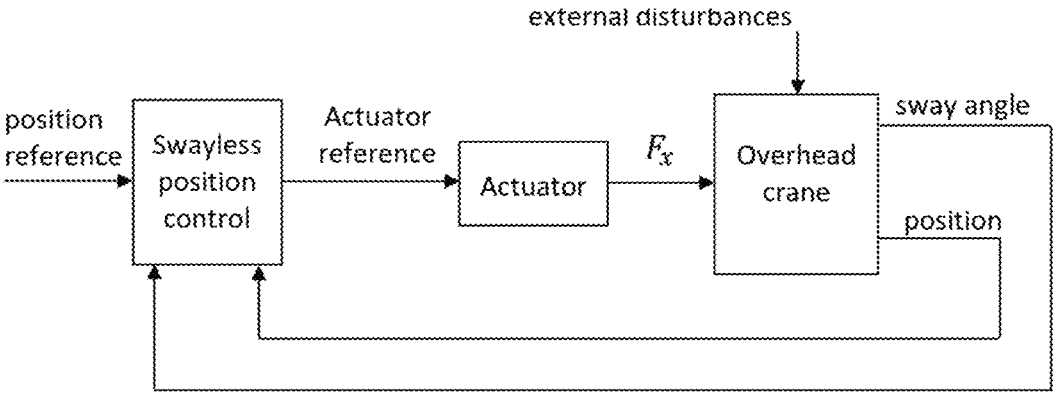
FIG. 2 shows a high-level block diagram of closed-loop swayless position control of an overhead crane.

FIG. 2 shows a high-level block diagram of a swayless position control system of the overhead crane of the disclosure. The input of the system is a position reference for the trolley. In the example of FIG. 2, the swayless position controller uses the two measured output signals, i.e. sway angle and position, as feedback and computes a control reference for the actuator. The actuator reference is calculated in the invention to drive the trolley to the reference position in a manner, which leaves no residual swaying even under external disturbances. Further, by generating a mechanical force $F_x$, the actuator drives the trolley to the target position in accordance with the actuator reference set by the swayless position controller.

In the invention, model-based control method is used for the swayless position controller and a model of the crane system under consideration is created. A nonlinear physical model of an overhead crane is derived from its equations of motion and presented in state-space form. The non-linear model is used in the simulations to demonstrate the operation of the controller. The effect of wind disturbances on the system is modelled as a force acting on the pendulum and is included in the nonlinear model. Further, a linearized model of the system in state-space form is formed and used for controller design purposes.

Figure 3:
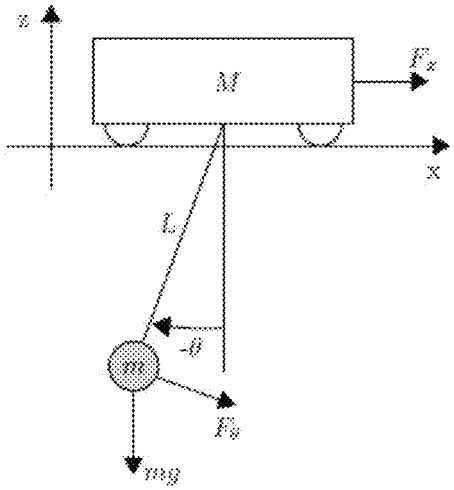
FIG. 3 shows an overhead crane model for trolley movement.

A model of the overhead crane for the trolley movement is shown in FIG. 3. The actuator output force $F_x$ used to drive the trolley causes the payload to oscillate around the cable-trolley attachment point and the payload is treated as a one-dimensional pendulum. The trolley and the payload are considered as point masses and the tension force, which may cause the hoisting cable to elongate, is ignored. In addition, it is assumed that there is no friction in the system.

In FIG. 3 L is the length of the cable. The mass and position of the trolley are M and x, respectively. The sway angle and the mass of the payload are θ and m, respectively. The position vectors of the payload and trolley on a two-dimensional plane can be defined as $$s_L=\{x+L\sin(\theta),-L\cos(\theta)\} \tag{1}$$

$$s_T=\{x,0\} \tag{2}$$

The kinetic energy of the overhead crane system is $$\begin{aligned} E_k &= \frac{1}{2}M\dot{s}_T\cdot\dot{s}_T+\frac{1}{2}m\dot{s}_L\cdot\dot{s}_L \\ &= \frac{1}{2}M\dot{x}^2+\frac{1}{2}m\left[\left(\dot{x}^2+\dot{L}\sin(\theta)+L\dot{\theta}\cos(\theta)\right)^2+\left(-\dot{L}\cos(\theta)+L\dot{\theta}\sin(\theta)\right)^2\right] \end{aligned} \tag{3}$$

The potential energy is $$U=-mgL\cos(\theta) \tag{4}$$

where g is the gravitational acceleration.

The Euler-Lagrange equation is used in characterizing the dynamic behavior of the crane system and it is defined as follows:

$$\frac{d}{dt}\left(\frac{\partial\mathcal{L}}{\partial\dot{q}_i}\right)-\frac{\partial\mathcal{L}}{\partial q_i}=F_i,\ i=1,2 \tag{5}$$

where $\mathcal{L}=E_k-U$ is the Lagrangian and the generalized forces corresponding to the generalized displacements $$q=\{x,\theta\}$$

are $$F=\{F_x,F_\theta\}.$$

The generalized displacement coordinates are the chosen variables which describe the crane system. The viscous damping force Fe is defined as $$F_\theta=-bL\dot{\theta} \tag{6}$$

where b is the damping coefficient.

The equations of motion are obtained by solving Lagrangian's equation (5):

$$(m+M)\ddot{x}+mL\ddot{\theta}\cos(\theta)+m\dot{L}\dot{\theta}\cos(\theta)-mL\dot{\theta}^2\sin(\theta)=F_x \tag{7a}$$

$$mL(L\ddot{\theta}+g\sin(\theta)+2\dot{\theta}\dot{L}+\ddot{x}\cos(\theta))=-bL\dot{\theta} \tag{7b}$$

Figure 4:
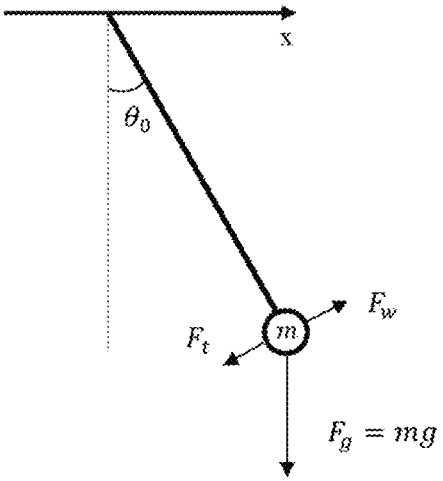
FIG. 4 shows force of the wind acting on the pendulum.

The desired positioning controller has to be able to compensate wind disturbances coming from the same or opposite direction as the payloads direction of motion. FIG. 4 describes the impact of such wind disturbances on the pendulum in steady state.

In FIG. 4 $F_t$ is the tangential component of the gravitational force $F_g$. It describes the force, which the wind needs to overcome to be able to deviate the sway angle by the amount of $\theta_0$ in steady state. Now we can approximate the effect of the wind on the pendulum by defining the tangential force component of the wind $F_w$ as $$F_w=-F_t=mg\sin(\theta_0) \tag{9}$$

The equations of motion (7a) can now be completed by adding the steady state tangential force component $F_w$ of the wind to the equations $$(m+M)\ddot{x}+mL\ddot{\theta}\cos(\theta)+m\dot{L}\dot{\theta}\cos(\theta)-mL\dot{\theta}^2\sin(\theta)=F_x \tag{10a}$$

$$mL(L\ddot{\theta}+g\sin(\theta)+2\dot{\theta}\dot{L}+\ddot{x}\cos(\theta))=F_w-bL\dot{\theta} \tag{10b}$$

The idea of the disclosure is to use state-space methods for designing a swayless position controller. For this reason, the equations of motion (10a) and (10b) are expressed as state equations, i.e., functions of state variables, actuator output force $F_x$ and wind disturbance force $F_w$. Since Eqs. (10a) and (10b) contain nonlinear functions and do not have a finite number of analytical solutions, first a nonlinear state-space model of the system is created. However, the equations of motion can be linearized with reasonable assumptions, which will be explained later. Linearizing the system model enables to use linear analysis in the controller design and the linear model is used as a starting point for the observer-based state-space swayless position controller development of the invention. Before forming the state equations of a system, the state variables of the state vector x are chosen first.

Based on the system described in (10a), the state vector x is defined as follows:

$$x=\begin{bmatrix}p\\ \theta\\ \dot{p}\\ \dot{\theta}\end{bmatrix}=\begin{bmatrix}p\\ \theta\\ v\\ \Omega\end{bmatrix}=\begin{bmatrix}\text{trolley position}\\ \text{swing angle}\\ \text{trolley velocity}\\ \text{angular velocity}\end{bmatrix} \tag{12}$$

and the state equations of the nonlinear crane system are $$x=\begin{bmatrix}\dot{p}\\ \dot{\theta}\\ \ddot{p}\\ \ddot{\theta}\end{bmatrix} \tag{13}$$

where $$\dot{p}=v$$
$$\dot{\theta}=\Omega$$
$$\ddot{p}=\frac{F_x+\cos(\theta)\left(m\dot{L}\dot{\theta}+mL\dot{\theta}^2\sin(\theta)-\frac{F_w}{L}+b\dot{\theta}+mg\sin(\theta)\right)}{(m+M-m\cos(\theta)^2)}$$
$$\ddot{\theta}=\frac{1}{L}\left(\frac{F_w}{m_L}-\frac{b\dot{\theta}}{m}-g\sin(\theta)-2\dot{L}\dot{\theta}-\cos(\theta)\left(\frac{F_x+\cos(\theta)\left(m\dot{L}\dot{\theta}+mL\dot{\theta}^2\sin(\theta)-\frac{F_w}{L}+b\dot{\theta}+mg\sin(\theta)\right)}{(m+M-m\cos(\theta)^2)}\right)\right)$$

The nonlinear equations of motion (13) are linearized with the following assumptions. It is assumed that the swing angles are small and the cable length is kept constant, and the sine and cosine terms are approximated with the first terms of their Taylor polynomials, thus $\sin(x)\approx x$ and $\cos(x)\approx 0$. The approximation error is less than 1% when $\theta<14°$ and less than 5% when $\theta=30°$. In addition, due to the small swing angle, the square of the derivative of the swing angle is approximated to be zero, i.e. $\dot{\theta}^2\approx 0$.

Since extremely light damping is characteristic for overhead cranes it is assumed for the linearized equations of motion that the damping ratio b is zero. Additionally, the wind disturbance force $F_w$ and the changes in cable length, i.e. derivative of L are omitted.

As the linearized model is used for the controller design, the actuator output force $F_x$ is denoted directly as the position controller output $F_{x,ref}$ in the linearized equations. Based on these aforementioned approximations, the equations of motion are written in the following form:

$$(m+M)\ddot{p}+mL\ddot{\theta}=F_{x,ref} \tag{14a}$$

$$\ddot{\theta}+\frac{g}{L}\theta+\frac{\ddot{p}}{L}=0 \tag{14b}$$

The linearized equations of motion, are now be presented as state equations $$\dot{x}=\begin{pmatrix}\dot{p}\\ \dot{\theta}\\ \ddot{p}\\ \ddot{\theta}\end{pmatrix}=\begin{pmatrix}v\\ \Omega\\ \frac{mg}{M}\theta+\frac{1}{M}F_{x,ref}\\ -\frac{g(M+m)}{ML}\theta-\frac{1}{ML}F_{x,ref}\end{pmatrix} \tag{15}$$

Equation (15) can also be expressed in the general state-space matrix form $$\begin{cases}\dot{x}=Ax+BF_{x,ref}\\ p=Cx\end{cases} \tag{16a}$$

where the system matrix A describes the internal dynamics of the system and the input vector B describes the impact of the control signal $F_{x,ref}$ on the state variables. A and B are defined based on Eqs. (15) and (16a) as $$A = \begin{bmatrix} 0 & 0 & 1 & 0 \\ 0 & 0 & 0 & 1 \\ 0 & \frac{mg}{M} & 0 & 0 \\ 0 & -\frac{(M+m)g}{ML} & 0 & 0 \end{bmatrix} \tag{16b}$$

$$B = \begin{bmatrix} 0 \\ 0 \\ \frac{1}{M} \\ -\frac{1}{ML} \end{bmatrix} \tag{16c}$$

Since the trolley position is set as the system output, the output matrix C can be defined as $$C=[1\ 0\ 0\ 0] \tag{16d}$$

Figure 5:
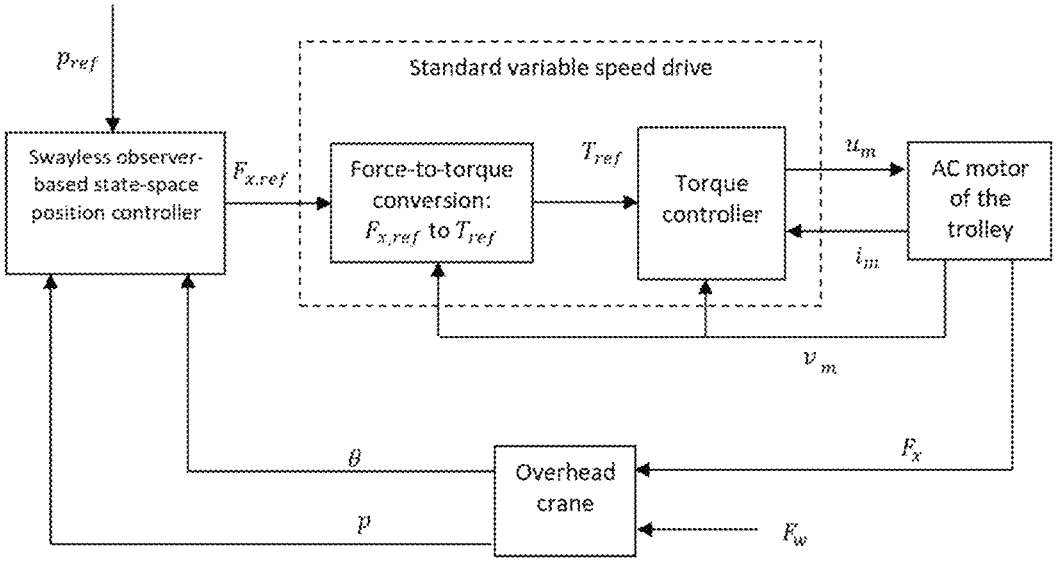
FIG. 5 shows basic principle of swayless position control of an overhead crane when using a variable speed drive controlled AC motor as the actuator.

The linear state-space model of the system presented in Eqs. (16a . . . 16d) is used for the position controller design of the invention In the disclosure, the swayless position controller is designed to be combined with a variable speed drive controlled AC motor as the actuator. Furthermore, it is assumed that the variable speed drive is capable of precise and fast torque control. The swayless positioning of an overhead crane is thereby based on cascade control, where the inner loop is the fast torque controller of the drive and the outer loop is a slower swayless position controller. The integration of the swayless position controller to the overhead crane control system is shown in FIG. 5.

As mentioned above, the crane system under consideration has two determined output signals, which according to an embodiment are the position of the trolley p and the sway angle of the payload θ. The trolley position reference $p_{ref}$ is used as input. The swayless position controller uses the two determined output signals as feedback and calculates the force $F_{x,ref}$ required to drive the trolley to the reference position in accordance with the acceleration and speed limitations of the crane and without residual swaying of the payload even in windy conditions. In the force-to-torque conversion block, the output $F_{x,ref}$ of the position controller is converted into a torque reference $T_{ref}$ and fed to the torque control loop of the drive as shown is FIG. 5. The operation of the force-to-torque conversion block is explained below in more detail. The torque controller adjusts the drives output voltage $u_m$, which is fed to the motor of the trolley. The voltage $u_m$ controls the motor to generate the desired mechanical torque, and thereby the desired force initially set by the position controller, on the trolley. As a result, the mechanical torque of the motor drives the trolley to the target position with dynamics set by the swayless position controller.

The torque controller and the motor of the trolley are not described in detail, as the torque control is assumed to be accurate and much faster than the swayless position controller. In addition, the transmission line of the trolley is omitted as well. The control system is designed by using directly the swayless position controller output force $F_{x,ref}$ for the crane positioning.

The implementation of two-degrees-of-freedom crane positioning with observer-based state-space control capable of withstanding external disturbances such as wind is presented in the following. The controller design is performed in continuous-time as it simplifies taking into account the characteristic physical phenomena of the system, such as the natural resonance frequency, in the control analysis. First, analytical expressions for the gain values of the state-space controller are derived by assuming all states are measured. Next, two different state observer approaches for utilizing the two measurement signals of the crane system are introduced and analytical expressions for their gain values are presented. The second degree-of-freedom is added to the control structure by developing a technique to create a smooth positioning profile out of a step input reference. And finally, the designed observer-based state-space controllers are implemented in discrete-time.

Figure 6:
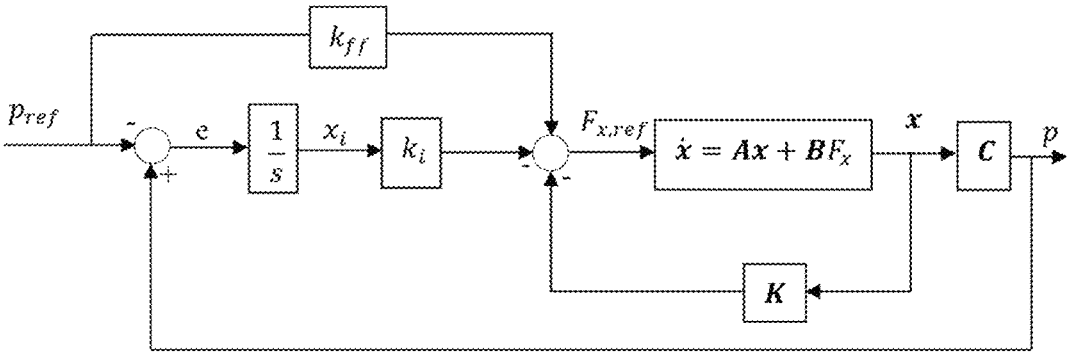
FIG. 6 shows a block diagram of a state feedback controller with integral action.

The structure of the swayless position state-space controller of the crane is shown in FIG. 6. The crane dynamics are modelled for the position controller based on the state-space model of Eqs. (16a . . . 16d). The state variables are the position of the trolley p, the speed of the trolley $\dot{p}$, the angle of the sway θ and the angular velocity of the sway $\dot{\theta}$. The controller output is the desired force $F_{x,ref}$ to be applied to the trolley. In the controller structure presented in the example of FIG. 6, the closed-loop poles are placed with the feedback gain vector K and with the integrator gain $k_i$. The feedforward gain $k_{ff}$ for the position reference $p_{ref}$ gives one additional degree-of-freedom for placing the closed-loop zeros.

The integral action is added to the control system as it is needed to remove the steady-state error in input reference tracking. Now the state-space description of (16a . . . 16d) can be augmented with an integral state $$x_i=\int(p-p_{ref})dt \tag{17}$$

The idea is to create a state within the controller that computes the integral of the error signal $e=p-p_{ref}$, which is then used as a feedback term.

The derivative of the integral state can be expressed based on the position reference and the state variables $$\dot{x}_i=p-p_{ref}=Cx-p_{ref} \tag{18}$$

Now the control law of the augmented closed-loop system is $$F_{x,ref}=-Kx-k_ix_i+k_{ff}p_{ref} \tag{19}$$

Based on the expressions of the derivative (18) of the integrator state, the control law (19) and the open-loop state space model (16a . . . 16d) the closed-loop state-space description of the control system is presented in the following form $$\begin{cases} \dot{x} = Ax + B(-Kx - k_ix_i + k_{ff}\,p_{ref}) \\ \dot{x}_i = Cx - p_{ref} \\ p = Cx \end{cases} \tag{20}$$

The augmented closed-loop state-space model is written in matrix format as $$\begin{bmatrix} \dot{x} \\ \dot{x}_i \end{bmatrix} = \underbrace{\begin{bmatrix} A-BK & -Bk_i \\ C & 0 \end{bmatrix}}_{\bar{A}} \begin{bmatrix} x \\ x_i \end{bmatrix} + \underbrace{\begin{bmatrix} Bk_{ff} \\ -1 \end{bmatrix}}_{\bar{B}} p_{ref} \tag{21a}$$

-continued $$p = \underbrace{[C \;\; 0]}_{\tilde{C}} \begin{bmatrix} x \\ x_i \end{bmatrix} \tag{21b}$$

where $\tilde{A}$ is the closed-loop system matrix, $\tilde{B}$ is the input matrix of the closed-loop system and $\tilde{C}$ is the output matrix of the closed-loop system. Since the system has four state variables, the feedback vector K is defined as $$K=[k_1 k_2 k_3 k_4] \tag{22}$$

The transfer function of the closed-loop system can be solved from the closed-loop state-space model of Eqs. (21a) and (21b)

$$G(s) = \frac{p(s)}{p_{ref}(s)} = \tilde{C}(sI - \tilde{A})^{-1}\tilde{B} = \frac{b_3 s^3 + b_2 s^2 + b_1 s + b_0}{s^5 + a_4 s^4 + a_3 s^3 + a_2 s^2 + a_1 s + a_0} \tag{23}$$

where the characteristic equation is $$C(s)=\det(sI-\tilde{A})=s^5+a_4 s^4+a_3 s^3+a_2 s^2 a_1 s+a_0 \tag{24}$$

The coefficients for the numerator polynomial of the closed-loop transfer function can be solved from Eq. (24)

$$b_3 = \frac{k_{ff}}{M} \tag{25a}$$

$$b_2 = \frac{k_i}{M} \tag{25b}$$

$$b_1 = \frac{g k_{ff}}{LM} \tag{25c}$$

$$b_0 = \frac{g k_i}{LM} \tag{25d}$$

The coefficients of the characteristic equation are solved similarly from Eq. (24)

$$a_0 = \frac{g k_i}{LM} \tag{26a}$$

$$a_1 = \frac{g k_1}{LM} \tag{26b}$$

-continued $$a_2 = \frac{L k_i + g k_3}{LM} \tag{26c}$$

$$a_3 = \frac{mg - k_2 + Mg + L k_1}{LM} \tag{26d}$$

$$a_4 = \frac{L k_3 - k_4}{LM} \tag{26e}$$

As can be seen from Eqs. (26a . . . 26e), the closed-loop system dynamics or in other words the coefficients of the characteristic equation, can be defined based on the state feedback coefficients $k_1$ . . . $k_4$ and the integrator gain $k_i$. Additionally, a closed-loop zero can be placed with the feedforward gain $k_{ff}$.

Choosing the closed-loop pole locations can be challenging. However, some tools for finding the appropriate closed-loop pole locations for a crane system are known in the art. The most common ones are LQ (linear quadratic) control and analytical pole placement methods where the closed-loop poles are placed using the open-loop and the desired closed-loop characteristics (e.g., resonance damping, rise time and overshoot) of the system. Since the open-loop characteristics such as the natural resonance frequency can be easily identified from the overhead crane system in question, an analytical pole placement method, which uses the open-loop pole locations as a starting point, is used for the state-space controller design.

The linearized open-loop crane system has two poles in the origo and one undamped pole pair at its natural resonance frequency ($s=\pm j\omega_n$). Now the five poles of the closed loop characteristic equation (24) are divided into a pair of complex poles (resonant poles), a pair of real poles (dominant poles) and a single pole (integrator pole). The characteristic equation of such a system is $$C(s)=(s+\omega_i)(s+\omega_d)^2(s^2+2\xi_r\omega_r s+\omega_r^2) \tag{27}$$

where $\omega_d$ is the dominant pole frequency, $\omega_i$ is the integrator pole frequency, $\omega_r$ is the resonant pole frequency and $\xi_r$ is the damping ratio for the resonant pole frequency.

When the coefficients of the characteristic polynomial Eq. (24) of the closed-loop system are set to equal the desired coefficients Eq. (27) of the closed-loop system, the integrator gain $k_i$ and the coefficients of the feedback gain matrix K can be solved $$k_1 = \frac{(2\xi_r\omega_d^2\omega_i\omega_r + \omega_d^2\omega_r^2 + 2\omega_d\omega_i\omega_r^2)LM}{g} \tag{28a}$$

$$k_2 = g(m+M) + Lk_1 - (\omega_r^2 + 4\xi_r\omega_d\omega_r + \omega_d^2 + 2\xi_r\omega_r\omega_i + 2\omega_d\omega_i)LM \tag{28b}$$

$$k_3 = \frac{(\omega_i\omega_r^2 + 2\omega_d\omega_r^2 + \omega_d^2\omega_i + 2\xi_r\omega_r\omega_d^2 + 4\xi_r\omega_d\omega_r\omega_i + 2\omega_d\omega_i)LM - Lk_i}{g} \tag{28c}$$

$$k_4 = Lk_3 - (2\xi_r\omega_r + \omega_i + 2\omega_d)LM \tag{28d}$$

$$k_i = \frac{\omega_d^2\omega_i\omega_r^2 LM}{g} \tag{28e}$$

Since the natural resonance frequency $\omega_n$ is directly proportional to the length of the cable, the closed-loop pole frequencies $\omega_r$, $\omega_d$ and are expressed as functions of $\omega_n$. The idea of the state-space crane position control is to keep the speed curve of the trolley smooth and the control effort $F_{x,ref}$ reasonable by placing the closed-loop poles appropriately. The control effort of the controller is proportional to the amount the open-loop poles are moved on the complex plane. When the cable is long and thereby the natural resonance frequency is low, the poles are moved closer to the origo on the left side of the complex plane. On the contrary, with a shorter cable the natural period of the pendulum is shorter so the trolley can be controlled with faster dynamics (poles closer to origo). In other words linking the pole locations to the length of the cable ensures desired closed-loop dynamics in all operating points.

The natural period of the crane pendulum $\tau$ is defined as $$\tau = 2\pi\sqrt{\frac{L}{g}} \tag{29}$$

and the natural resonance frequency as $$\omega_n = \frac{2\pi}{\tau} \tag{30}$$

As mentioned before, the open-loop resonant pole pair has zero damping. To optimize control effort, it is desired to leave the resonant pole pair at the natural resonance frequency ($\omega_r=\omega_n$). This way the control effort is used to damp the resonating pole pair by tuning its damping ratio $\xi_r$. The pair of complex resonant poles $s_{\omega r1,2}$ can be placed in the following way $$s_{\omega r1,2}=-\xi_r\omega_r\pm\omega_r\sqrt{\xi_r^2-1} \tag{31}$$

The dominant pole pair can now be used to adjust the desired dominant dynamics of the closed-loop system. The dominant pole frequency can be presented as $$\omega_d=d\omega_n \tag{32}$$

where d is the dominant pole frequency coefficient. The integrator pole frequency needs to be higher than $\omega_d$ and $\omega_r$ and it is defined as $$\omega_i=p\omega_n \tag{33}$$

where p>d is the integrator pole frequency coefficient.

The feedback gains $k_1 \ldots k_4$ and the integrator gain $k_i$ are defined based on the closed-loop pole placement. With the feedforward gain $k_{ff}$ a zero is placed to the closed-loop system which can enhance the closed-loop step response. One natural way to place the zero is to cancel one of the poles of the system with it. The dominant pole pair is at the frequency $\omega_d$ so by defining the feedforward gain as $$k_{ff} = \frac{\omega_d\omega_i\omega_r^2 LM}{g} \tag{34}$$

one of the dominant poles $s=-\omega_d$ can be compensated.

Now as the equations for the controller gains $k_1 \ldots k_4$, $k_i$ and $k_{ff}$ have been derived, the swayless position controller output can be solved based on Eqs. (28a . . . 28e) and (34) as $$F_{x,ref}=-Kx-k_ix_i+k_{ff}p_{ref} \tag{35}$$

As mentioned above in connection with the state-space controller design, it is assumed that all the state variables are known (measured) at all times. Since the crane system of the disclosure has only measurements for two state variables (p and $\theta$), a state observer for estimating the remaining two state variables ($\dot{p}$ and $\dot{\theta}$) based on the controller output $F_{x,ref}$ and the output measurements is employed. As mentioned above, implementing an accurate and noise-free sway angle measurement is known to be problematic.

According to embodiments of the invention, state observer used in the invention is either a reduced-order observer or a full-order observer. A reduced-order state observer has less filtering capability for a noisy measurement input whereas finding its optimal observer pole locations is quite straightforward. On the other hand, a full-order observer has the ability to filter measurement noise much more effectively but finding its optimal pole locations can be more complicated.

Figure 7:
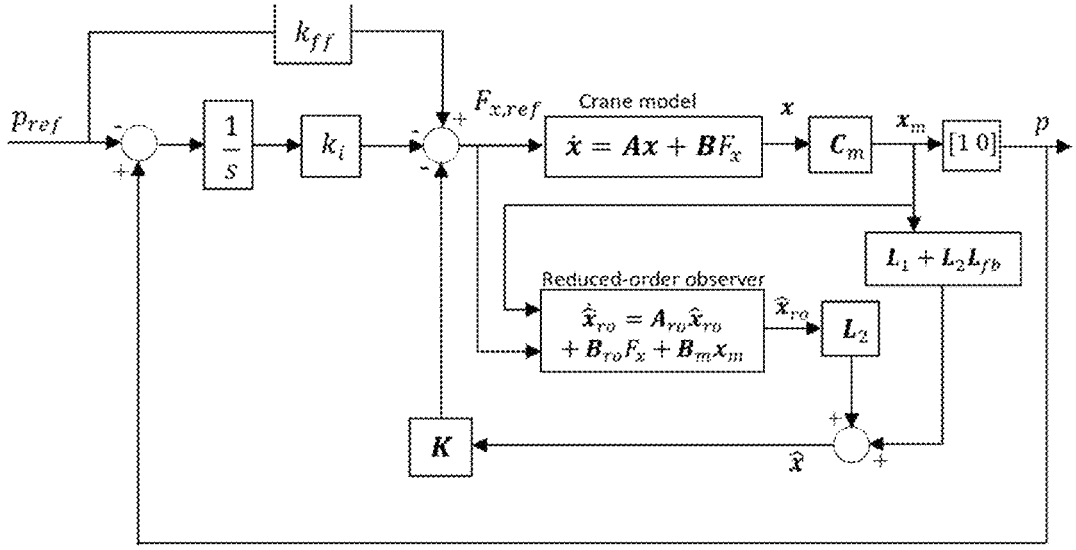
FIG. 7 shows a block diagram of combining state feedback control with a reduced-order observer.

The block diagram of combining state-feedback control with a reduced-order observer is shown in FIG. 7. Before defining the equations for the reduced-order observer, some of the system matrixes introduced above have to be arranged into a slightly different form. As mentioned before, the actual system has two output measurements, which are the position of the trolley and the sway angle of the cable. Now two separate output matrixes are created $$C_m = \begin{bmatrix} 1 & 0 & 0 & 0 \\ 0 & 1 & 0 & 0 \end{bmatrix} \tag{36}$$

and $$C_e = \begin{bmatrix} 0 & 0 & 1 & 0 \\ 0 & 0 & 0 & 1 \end{bmatrix} \tag{37}$$

where $C_m$ is the output matrix for the two measured state variables and $C_e$ is the output matrix for the two state variables that are estimated using the reduced-order observer. Now the measured states $x_m$ can be defined as $$x_m = C_m x = \begin{bmatrix} x_1 \\ x_2 \end{bmatrix} = \begin{bmatrix} p \\ \theta \end{bmatrix} \tag{38}$$

and the estimated states as $$\hat{x}_{ro} = C_e x = \begin{bmatrix} \hat{x}_3 \\ \hat{x}_4 \end{bmatrix} = \begin{bmatrix} \dot{\hat{p}} \\ \dot{\hat{\theta}} \end{bmatrix} \tag{39}$$

As can be seen from FIG. 7, the designed reduced-order observer takes the controller output $F_x$, and the two measured states $x_m$ as input and estimates the remaining two state variables $\hat{x}_{ro}$. The output of the reduced-order observer is the estimated state matrix $\hat{x}$, which is a combination of the two measured states and the two estimated states:

$$\hat{x} = \begin{bmatrix} x_m \\ \hat{x}_{ro} \end{bmatrix} = \begin{bmatrix} p \\ \theta \\ \dot{\hat{p}} \\ \dot{\hat{\theta}} \end{bmatrix} \tag{40}$$

Based on the two output matrixes $C_m$ and $C_e$, two more matrixes are defined for the reduced-order observer with the notation $$\begin{bmatrix} C_m \\ C_e \end{bmatrix}^{-1} = [L_1 \ L_2] \tag{41}$$

The matrixes $L_1$ and $L_2$ can now be solved based on Eq. (41) as $$L_1 = \begin{bmatrix} 1 & 0 \\ 0 & 1 \\ 0 & 0 \\ 0 & 0 \end{bmatrix} \tag{42}$$

$$L_2 = \begin{bmatrix} 0 & 0 \\ 0 & 0 \\ 1 & 0 \\ 0 & 1 \end{bmatrix} \tag{43}$$

Now we can define a reduced-order observer $\dot{\hat{x}}_{ro}$ for the estimated states $\hat{x}_{ro}$ as follows $$\dot{\hat{x}}_{ro} = A_{ro}\hat{x}_{ro} + B_{ro}F_{x,ref} + B_m x_m \tag{44a}$$

where $$A_{ro} = C_e A L_2 - L_{fb} C_m A L_2 \tag{44b}$$

$$B_{ro} = C_e B - L_{fb} C_m B \tag{44c}$$

$$B_m = C_e A L_2 L_{fb} + C_e A L_1 - L_{fb} C_m A L_1 - L_{fb} C_m A L_2 L_{fb} \tag{44d}$$

In the reduced-order observer Eqs. (44a . . . 44d), the matrix $A_{ro}$ describes the internal dynamics of the observer and the input vector $B_{ro}$ describes the impact of the control signal $F_{x,ref}$ on the estimated state variables $\hat{x}_{ro}$. The input matrix $B_m$ describes the effect of the measured states $x_m$ on the estimated state variables.

The estimates of the state-space variables of the original system are now obtained as $$\hat{x} = L_2\hat{x}_{ro} + (L_1 + L_2 L_{fb})x_m \tag{45}$$

Based on the definition of $\hat{x}$ in Eq. (45), it is noticed that the reduced-order observer only uses half of the system model for estimation purposes. It estimates only the two states $$(\hat{x}_{ro} = [\hat{p}\hat{\theta}]^T)$$

which are not measured. The measured states $$(x_m = [p\theta]^T)$$

are only multiplied with the observer feedback gain $L_{fb}$ and then summed with the estimated states at the output of the observer. In other words, the ability of the reduced-order observer to filter possible noise from a measurement $x_m$ is limited since the observer is not estimating the measured states $x_m$ and thereby not minimizing any estimation error regarding $x_m$.

The observer feedback gain can be defined based on the dimensions of the reduced-order observer as $$L_{fb} = \begin{bmatrix} L_{fb11} & L_{fb12} \\ L_{fb21} & L_{fb22} \end{bmatrix} \tag{46}$$

The poles of the reduced-order state observer can be placed in the same way as the poles of the state feedback controller. The equations for the observer feedback gain coefficients can be simplified by defining the observer poles as a pair of real poles. The characteristic equation of the reduced-order system matrix $A_{ro}$ is now $$\det[sI - (C_e A L_2 - L_{fb} C_m A L_2)] = (s + \omega_{ro})^2 \tag{47}$$

where $\omega_{ro}$ is the reduced-order observer pole pair.

Based on the characteristic equation (47), the observer feedback gain coefficients can be solved as $$L_{fb11} = \omega_{ro} \tag{48a}$$

$$L_{fb12} = 0 \tag{48b}$$

$$L_{fb22} = 0 \tag{48c}$$

$$L_{fb12} = \omega_{ro} \tag{48d}$$

Figure 8:
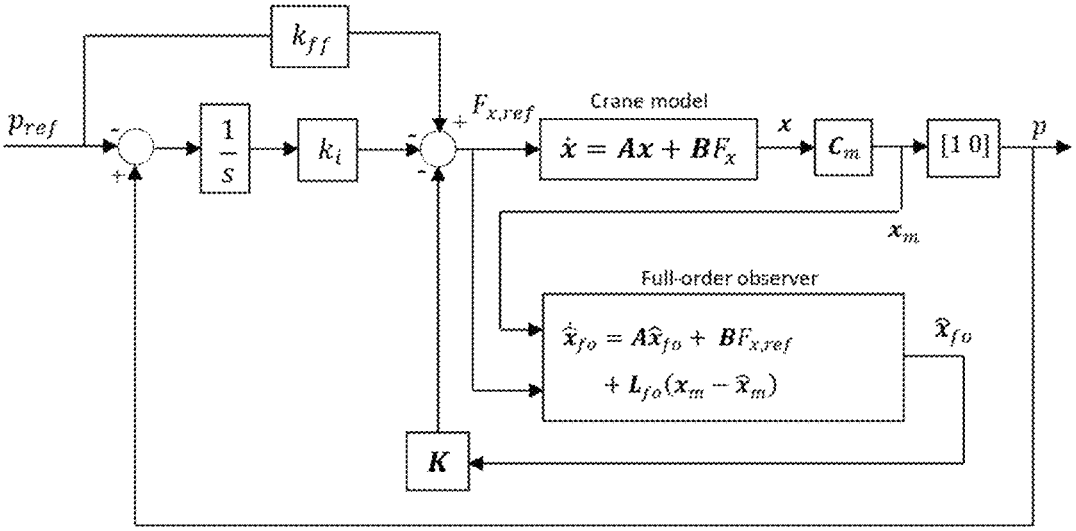
FIG. 8 shows a block diagram of combining state feedback control with a full-order observer.

An alternative for the reduced-order observer, a full order-order observer may be employed in the controller structure. The state vector x of the state-space model (16a . . . 16d) can be estimated by simulating a model representing the state-space description with the controller output force $F_{x,ref}$. The model can contain parameter inaccuracies or there might be external disturbances present, which would result in an erroneous estimate $\hat{x}_{fo}$ of the state vector. However, the estimation error $(x_m - \hat{x}_m)$ can be corrected with a gain matrix $L_{fo}$, which leads to a full-order state observer of the following form $$\dot{\hat{x}}_{fo} = A\hat{x}_{fo} + BF_{x,ref} + L_{fo}(x_m - \hat{x}_m) = A\hat{x}_{fo} + BF_{x,ref} + L_{fo}(C_m x - C_m\hat{x}_{fo}) \tag{49a}$$

$$\hat{y}_{fo} = I_{4x4}\hat{x}_{fo} = C_{fo}\hat{x}_{fo} \tag{49b}$$

where $C_{fo}$ is the output matrix of the full-order observer. The block diagram of combining state feedback control with the full-order observer is shown in FIG. 8. Based on the state-space model (16a . . . 16d) and the full-order state observer (49a . . . 49b) the dynamics of the estimation error of the state variables $\tilde{x} = x - \hat{x}_{fo}$ can be presented as $$\dot{\tilde{x}} = \dot{x} - \dot{\hat{x}}_{fo} = Ax + BF_{x,ref} - [A\hat{x}_{fo} + BF_{x,ref} + L_{fo}(C_m x - C_m\hat{x}_{fo})] = Ax - L_{fo}C_m x - A\hat{x}_{fo} + L_{fo}C_m\hat{x}_{fo} = (A - L_{fo}C_m)(x - \hat{x}_{fo}) \tag{50}$$

which means $$\dot{\tilde{x}} = (A - L_{fo}C_m)\tilde{x} \tag{51}$$

Looking at the full-order observer equations (49a . . . 51), it is seen that the observer estimates also the state-variables which are already measured. If the full-order observer gain $L_{fo}$ is tuned appropriately to minimize the estimation error, it can provide filtering against noise in the output measurements $x_m$.

The poles of the full-order observer still need to be placed by deriving equations for the gains of the observer feedback matrix $L_{fo}$. Based on the dimensions of the system $L_{fo}$ is defined as $$L_{fo} = \begin{bmatrix} l_{11} & l_{12} \\ l_{21} & l_{22} \\ l_{31} & l_{32} \\ l_{41} & l_{42} \end{bmatrix} \tag{52}$$

The equations for the observer feedback gains can be simplified by defining the full-order observer poles as two pairs of real poles. The characteristic equation of the dynamics of the estimation error is now $$\det[sI-(A-L_{fo}C_m)]=(s+\omega_{fo1})^2(s+\omega_{fo2})^2 \tag{53}$$

where $\omega_{fo1}$ and $\omega_{fo2}$ are the pole frequencies of the full-order observer. Now the coefficients of the observer feedback gains are solved as $$l_{11} = \omega_{fo1} + \omega_{fo2} \tag{54a}$$

$$l_{12} = 0 \tag{54b}$$

$$l_{21} = \omega_{fo1} + \omega_{fo2} \tag{54c}$$

$$l_{22} = 0 \tag{54d}$$

$$l_{31} = \frac{2\omega_{fo1}^2\omega_{fo2} + 2\omega_{fo2}^2\omega_{fo1} - l_{11}\frac{mg}{LM} + \frac{g}{L}}{2*l_{11}} \tag{54e}$$

$$l_{32} = 0 \tag{54f}$$

$$l_{41} = 0 \tag{54g}$$

$$l_{42} = \frac{\sqrt{g^2(m+M)^2 + 4L^2M^2\omega_{fo2}^2\omega_{fo2}^2} + g(m+M)}{2*L*M} \tag{54h}$$

As a general rule, the poles of the observer should be 2 . . . 6 times faster than the poles of the state-feedback controller. When the observer is faster than the state feedback controller, it does not constrain the control rate. However, using a fast observer might cause problems when the measurement signal has a lot of noise. The state observer can be designed separately from the state feedback controller but it is important to acknowledge the impact of the observer poles to the dynamics of the entire system. The poles of the controlled system are a combination of poles of the observer and state feedback controller. In other words, the characteristic equation of the entire system is a product of observer poles and state feedback controller poles.

For the observer poles to be in line with the poles of the state feedback controller in all operating points, the observer poles are expressed as functions of the fastest pole $\omega_d$ of the state feedback controller. The reduced-order observer pole pair is defined as $$\omega_{ro}=r\omega_d \tag{55}$$

where r is the reduced-order observer pole coefficient.

The two pole pairs $\omega_{fo1}$ and $\omega_{fo2}$ of the full-order observer can be defined as $$\omega_{fo1}=f_1\omega_d \tag{56}$$

and $$\omega_{fo2}=f_2\omega_d \tag{57}$$

where $f_1$ and $f_2$ are the full-order observer pole coefficients, respectively.

As explained in connection with FIG. 5, the output $F_x$, of the swayless position controller must still be converted into a torque reference for the torque controller of the drive. The force-to-torque conversion block in FIG. 5 can be implemented using two different approaches: a direct conversion method or a dynamic conversion using the internal speed controller of the variable speed drive. In the direct conversion, the output $F_x$, of the position controller is converted into a torque reference based on the specifications of the electric motor of the trolley, gear ratio, inertia and friction.

Figure 9:
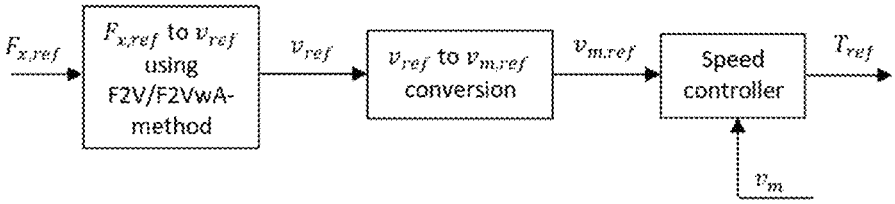
FIG. 9 shows an example of a block diagram of converting the position controller output to a torque reference using the speed controller of the drive.

A dynamic force-to-torque conversion procedure is described in connection with FIG. 9. In this procedure, it is assumed that the variable speed drive has a properly tuned internal speed controller. In the most common torque control methods of electric drives, such as the vector control or the direct torque control (DTC), the aforementioned speed controller is needed to form a cascade control structure with the torque control loop where the output of the speed controller is a torque reference for the torque control chain. The input of the speed controller is a motor speed reference. In order to utilize the speed controller of the drive for the force-to-torque conversion, a speed reference $v_{ref}$ for the trolley movement is first derived based on the position controller output $F_x$. This is achieved, for example, by first defining the relationship between the acceleration of the trolley and the position controller output force $F_x$, based on the linearized equations of motion (14a, 14b))

$$(m+M)\ddot{p}+mL\ddot{\theta}=F_{x,ref} \tag{58}$$

Two different methods for generating a speed reference for the trolley based the controller output are presented in the following. The first one referred to as the force-to-velocity reference conversion with angular acceleration (F2VwA-method) and the second one will be named as the force-to-velocity reference conversion without angular acceleration (F2V-method).

The F2VwA-method is directly based on Eq. (58) by solving its acceleration $$\ddot{p} = \frac{F_{x,ref} - mL\ddot{\theta}}{m+M} \tag{59}$$

The angular acceleration $\ddot{\theta}$ can be obtained from the derivative of the estimated angular velocity $\dot{\theta}$ provided by the state observer. Now using the F2VwA-method the position controller output $F_{x,ref}$ can be converted into a speed reference for the trolley by simply integrating the equation of the trolley acceleration (59)

$$\dot{p} = v_{ref,F2VwA} = \int \frac{F_{x,ref} - mL\ddot{\theta}}{m+M}dt \tag{60}$$

In the F2V-method the linearized equation of motion (58) is approximated even further to omit the estimate of the angular acceleration $\ddot{\theta}$. Since the swayless position controller is required to move the trolley smoothly and in accordance with the acceleration and speed limitations of the crane, the changes in the sway angle during motion are small and occur slowly compared to the cycle time of the position controller. That means the second derivative of the sway angle in Eq. (58) can be approximated to zero. The relationship of trolley acceleration and controller output can be thereby reduced to the following form $$\ddot{p} = \frac{F_{x,ref}}{m+M} \tag{61}$$

Now using the F2V-method a speed reference for the trolley can be generated by integrating the equation of the trolley acceleration (61)

$$\dot{p} = v_{ref,F2V} = \int \frac{F_{x,ref}}{m+M} dt \tag{62}$$

The estimate of the angular acceleration $\ddot{\theta}$ can contain noise in case of a noisy sway angle measurement. Therefore, in theory, the F2V-method can be more robust against measurement noise compared to the F2VwA-method. However, in case of a long cable, the speed reference generated using the F2V-method can be inaccurate.

In order to use the speed controller of the drive for the dynamic force-to-torque conversion, the speed reference of the trolley $v_{ref}$ created with either of the aforementioned methods is converted next into a motor speed reference $v_{m,ref}$ using only the gear ratio of the transmission line. The motor speed reference $v_{m,ref}$ is fed to the internal speed controller of the drive as shown in FIG. 9. The speed controller uses the measured or estimated motor speed $v_m$ as feedback and adjusts the motor speed to respond to the speed reference by producing a torque reference $T_{ref}$ for the fast torque controller.

Carrying out the dynamic force-to-torque conversion by utilizing the internal speed controller of the drive has in theory a few upsides over the direct force-to-torque conversion. First, it needs less information about the mechanics of the system, e.g., the conversion does not require friction compensation or information about the radius of the motor shaft. Secondly, since the dynamic conversion has integral action, it acts as a filter for possible measurement noise and thereby improves robustness. Due to the nature of state feedback control, noisy feedback measurements would cause spikes in the position controller output $F_{x,ref}$. The integral action of the dynamic force-to-torque conversion shown in Eqs. (60) and (62) filters the noise before feeding the trolley speed reference $v_{ref}$ up the control chain. On the contrary, the direct force-to-torque conversion is a static amplification and therefore the possible spikes in the position controller output $F_{x,ref}$ would result in a more noisy torque reference for the torque controller. In conclusion, using one of the two presented speed reference generation schemes, the dynamic force-to-torque conversion can be performed by utilizing the cascade control structure of a variable speed drive. This way the trolley can be controlled robustly via the speed controller with minimal knowledge of the mechanics of the system.

Figure 10:
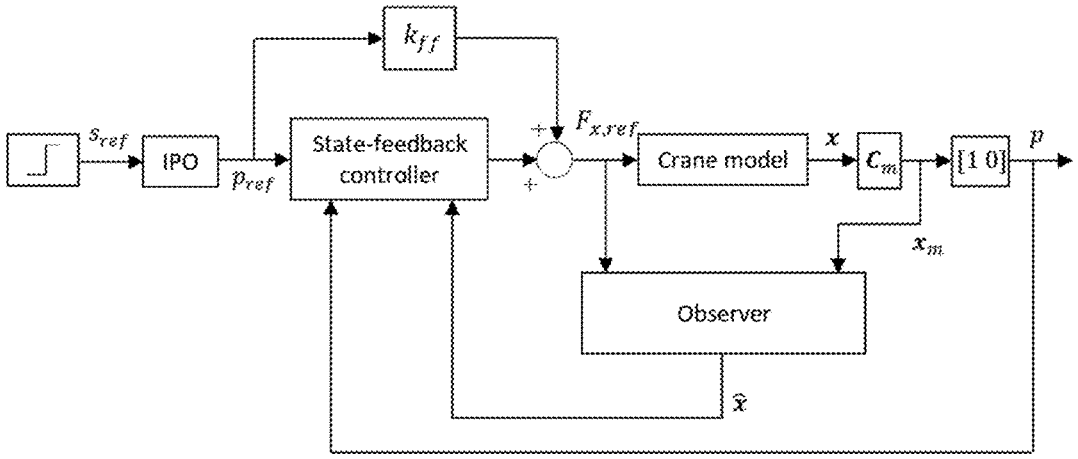
FIG. 10 shows a block diagram of the 2DOF crane position controller.

Motion control systems are often required to enable precise input reference tracking ability while being robust with desired closed-loop dynamics. The conventional solution has been a two-degrees-of-freedom controller, where regulation and command tracking are separately designed. Since the crane position controller should enable precise and smooth positioning without any residual swaying even in windy conditions, the 2DOF control structure is preferred. The observer-based state-space controller designed above is used to stabilize the feedback loop against model uncertainties and external disturbances, such as wind acting on the load of the crane. The feedforward gain $k_{ff}$ is preferably combined with a motion profile generator to improve the command-tracking ability. The block diagram of the 2DOF crane position controller is shown in FIG. 10. According to an embodiment, the position reference at the input of the controller is modified to a position profile. The obtained position profile limits the speed and acceleration of the trolley as presented below.

An interpolator (IPO) is used for generating the motion profile. The interpolator shapes a position step reference $s_{ref}$ into a smooth position curve $p_{re}$. The output of the interpolator depends on the desired maximum speed and acceleration limits set for the crane as well as the step reference. Now the positioning profile can be generated based on known equations of motion. The duration of the acceleration and deceleration phases is $t_{acc}$. The acceleration is defined as $$a_{acc} = \frac{v_t - v_{act}}{t_{acc}} \tag{63}$$

and the deceleration as $$a_{dec} = \frac{v_t}{t_{acc}} \tag{64}$$

where $v_t$ is the maximum travel speed of the trolley and $v_{act}$ is the actual speed. The acceleration distance $s_{acc}$ and deceleration distance $s_{dec}$ can be presented as $$s_{acc} = v_{act} t_{acc} + \frac{a_{acc} t_{acc}^2}{2} \tag{65}$$

and $$s_{dec} = \frac{a_{dec} t_{acc}^2}{2} \tag{66}$$

The duration of the constant speed phase is now $$t_c = \frac{s_t - s_{acc} - s_{dec}}{v_t} \tag{67}$$

where $s_t$ is the target position. If the duration of the constant speed is less than zero, the constant speed phase will be omitted. As a result, the positioning profile contains only the acceleration and deceleration phases and the new values for the accelerations are $$a_{acc} = \frac{s_t - 2 t_{acc} v_{act}}{t_{acc}^2} \tag{68}$$

$$a_{dec} = \frac{v_{act}}{t_{acc}} + a_{acc} \tag{69}$$

Figure 11:
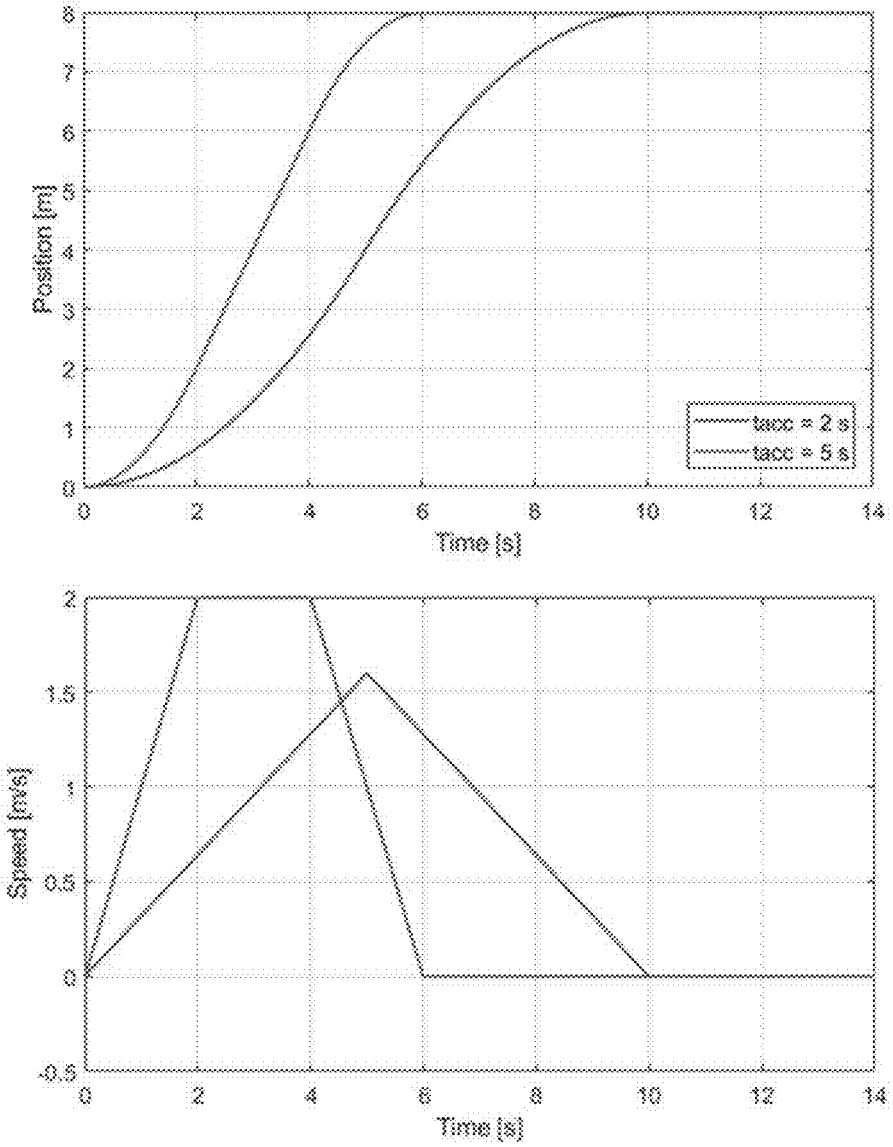
FIG. 11 shows a position reference and the corresponding speed profile created by an interpolator.

FIG. 11 shows the new position reference created with the interpolator out of a position step reference with different acceleration/deceleration times tact. The corresponding speed profiles are shown in the figure just to illustrate the characteristics of the interpolator. With a position reference $s_{ref}$=8 m, constant speed limit of $v_t$=2 m/s and a ramp time of $t_{acc}$=2 s the constant speed phase exists as shown in the FIG. 11. However, by increasing the ramp time to $t_{acc}$=5 s the constant speed phase is omitted as the positioning can only consist of the acceleration and deceleration phases. The new accelerations are calculated from Eqs. (68) and (69) and the speed profile is triangular.

The interpolator's positioning profile generated with respect to the maximum speed and acceleration limitations is important when using a state-space controller. The state-space controller has no knowledge of a maximum speed or acceleration limit nor the ability to restrict its control effort with respect to the speed of the trolley. The state-space controller only follows the created position reference with dynamics set by the closed-loop poles. Setting appropriate closed-loop dynamics for input reference tracking ensures that the speed and acceleration limitations of the crane are not violated.

The crane position controller above is presented in continuous-time. However, in practice the controller is implemented digitally with a microprocessor, which is why the discrete-time implementation of the controller is needed. Additionally, the simulation tests are be performed with the discretized control system.

There are multiple known discretization methods, such as the forward Euler approach, Tustin's method and the backward Euler approach. The Tustin's method is often used in practice and it provides satisfactory closed-loop system behavior as long as the sampling intervals are sufficiently small. Since the cycle time of the control program of the positioning controller is only 1 ms-10 ms and the crane system dynamics are relatively slow, the Tustin's method is used below as an example of a discretization approach. Now the control system of the invention can be discretized using Tustin's bilinear equivalent $$s = \frac{2}{T_s}\frac{1-z^{-1}}{1+z^{-1}} \tag{70}$$

where $T_s$ is the sampling period. For a general state-space representation $$\begin{cases} \dot{x}' = A'x' + B'u' \\ y' = C'x' + D'u' \end{cases} \tag{71}$$

the Tustin's method can be written as $$w(k+1)=\Phi w(k)+\Gamma u'(k) \tag{72a}$$

$$y'(k)=Hw(k)+Ju'(k) \tag{72b}$$

where w is a modified state vector and the discretized system matrices are $$\Phi = \left(I + \frac{T_s}{2}A'\right)\left(I - \frac{T_s}{2}A'\right)^{-1} \tag{73a}$$

$$\Gamma = T_s\left(I - \frac{T_s}{2}A'\right)^{-1}B' \tag{73b}$$

$$H = T_sC'\left(I - \frac{T_s}{2}A'\right)^{-1} \tag{73c}$$

-continued $$J = D' + \frac{T_s}{2}C'\left(I - \frac{T_s}{2}A'\right)^{-1}B' \tag{73d}$$

In the state-space controller, only the integrator is discretized using Eqs. (72a . . . 73d) with the following expressions $$y_i'=x_i'=x_i \tag{74a}$$

$$u_i'=p-p_{ref} \tag{74b}$$

$$A_i'=0 \tag{74c}$$

$$B_i'=1 \tag{74d}$$

$$C_i'=1 \tag{74e}$$

$$D_i'=\mathbf{0} \tag{74f}$$

Now the discretized system matrixes of the integrator are $$\Phi_i = \left(I + \frac{T_s}{2}A_i'\right)\left(I - \frac{T_s}{2}A_i'\right)^{-1} \tag{75a}$$

$$\Gamma_i = T_s\left(I - \frac{T_s}{2}A_i'\right)^{-1}B_i' \tag{75b}$$

$$H_i = T_sC_i'\left(I - \frac{T_s}{2}A_i'\right)^{-1} \tag{75c}$$

$$J_i = D_i' + \frac{T_s}{2}C_i'\left(I - \frac{T_s}{2}A'\right)^{-1}B_i' \tag{75d}$$

and the Tustin's method for the discretized integrator can be presented in state-space format $$w_i(k+1)=\Phi_i w_i(k)+\Gamma_i u_i(k) \tag{76a}$$

$$y_i'(k)=H_i w(k)+J_i u_i(k) \tag{72b}$$

where $w_i$ is the discrete state vector for the discretized integrator.

In the case of the full-order state observer, the gain matrix $L_{fo}$ is embedded into system matrices and the state-space matrices for the discretization are $$x_{fo}' = \hat{x}_{ro} \tag{77a}$$

$$u_{fo}' = \begin{bmatrix} F_{x,ref} \\ x_m \end{bmatrix} \tag{77b}$$

$$A_{fo}' = A - L_{fo}C_m \tag{77c}$$

$$B_{fo}' = [\,B \quad L_{fo}\,] \tag{77d}$$

$$C_{fo}' = I_{4\times4} \tag{77e}$$

$$D_{fo}' = 0 \tag{77f}$$

Based on Eqs. (77a . . . 77f) the discretized system matrices for the full-order observer are $$\Phi_{fo} = \left(I_{4\times4} + \frac{T_s}{2}A_{fo}'\right)\left(I_{4\times4} - \frac{T_s}{2}A_{fo}'\right)^{-1} \tag{78a}$$

-continued $$\Gamma_{fo} = T_s\left(I_{4\times4} - \frac{T_s}{2}A'_{fo}\right)^{-1} B'_{fo} \tag{78b}$$

$$H_{fo} = T_s C'_{fo}\left(I_{4\times4} - \frac{T_s}{2}A'_{fo}\right)^{-1} \tag{78c}$$

$$J_{fo} = D'_{fo} + \frac{T_s}{2}C'_{fo}\left(I_{4\times4} - \frac{T_s}{2}A'_{fo}\right)^{-1} B'_{fo} \tag{78d}$$

and the state-space representation is $$w_{fo}(k+1)=\Phi_{fo}w_{fo}(k)+\Gamma_{fo}u_{fo}'(k) \tag{79a}$$

$$y_{fo}'(k)=H_{fo}w_{fo}(k)+J_{fo}u_{fo}'(k) \tag{79b}$$

where $w_{fo}$ is the discrete state vector for the discretized full-order observer.

Using the Tustin's method, the reduced-order observer can be discretized similarly as the full-order observer with the following notations for its continuous-time state-space representation $$x' = \hat{x}_{ro} \tag{80a}$$

$$u'_{ro} = \begin{bmatrix} x_m \\ F_{x,ref} \end{bmatrix} \tag{80b}$$

$$A'_{ro} = A_q \tag{80c}$$

$$B'_{ro} = [\, B_m \quad B_{ro} \,] \tag{80d}$$

$$C'_{ro} = L_2 \tag{80e}$$

$$D'_{ro} = [\, L_1 + L_2 L_{fb} \quad 0 \,] \tag{80f}$$

Based on Eqs. (80a . . . 80f) the discretized system matrices for the reduced-order observer can be presented as $$\Phi_{ro} = \left(I_{2\times2} + \frac{T_s}{2}A'_{ro}\right)\left(I_{2\times2} - \frac{T_s}{2}A'_{ro}\right)^{-1} \tag{81a}$$

$$\Gamma_{ro} = T_s\left(I_{2\times2} - \frac{T_s}{2}A'_{ro}\right)^{-1} B'_{ro} \tag{81b}$$

$$H_{ro} = T_s C'_{ro}\left(I_{2\times2} - \frac{T_s}{2}A'_{ro}\right)^{-1} \tag{81c}$$

$$J_{ro} = D'_{ro} + \frac{T_s}{2}C'_{ro}\left(I_{2\times2} - \frac{T_s}{2}A'_{ro}\right)^{-1} B'_{ro} \tag{81d}$$

Now discretized system matrices of the reduced-order observer can be inserted into the state-space representation $$w_{fo}(k+1)=\Phi_{fo}w_{fo}(k)+\Gamma_{fo}u_{fo}'(k) \tag{82a}$$

$$y_{fo}'(k)=H_{fo}w_{fo}(k)+J_{fo}u_{fo}'(k) \tag{82b}$$

where $w_{fo}$ is the discrete state vector for the discretized full-order observer.

Figure 12:
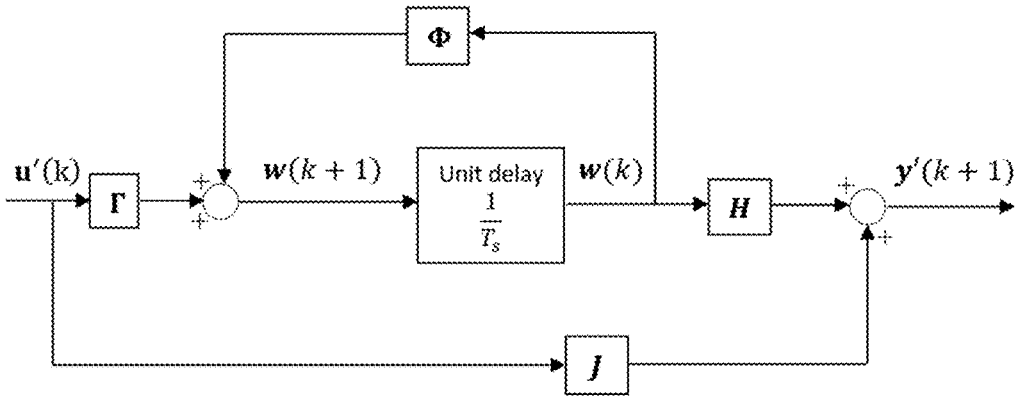
FIG. 12 shows an example of a discrete-time implementation of a state-space model.

Finally, the discrete-time state-space description of the integrator as well as the full-order and the reduced-order observer can be implemented by using their respective discretized system matrices as shown in FIG. 12.

Figure 13:
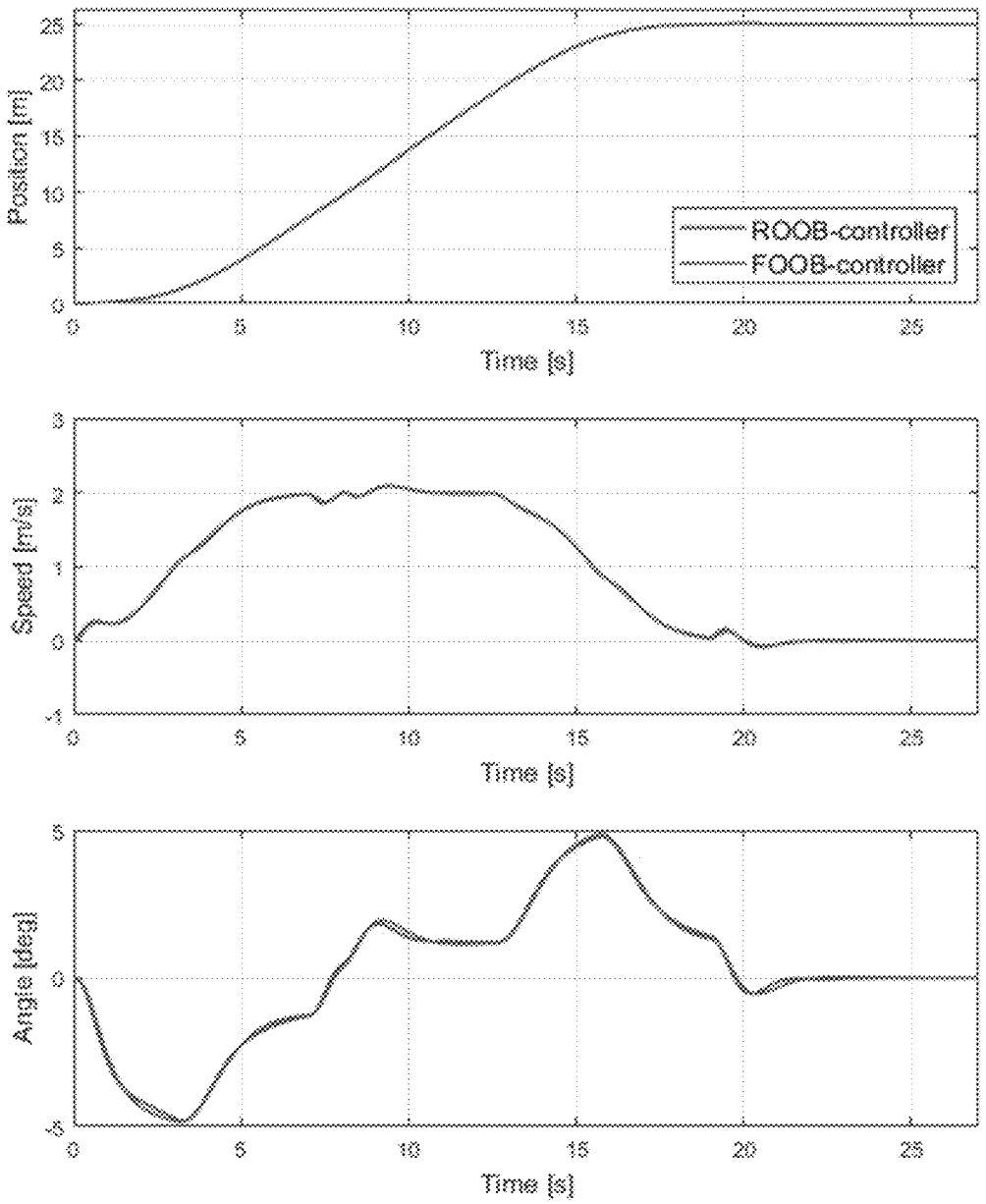
FIG. 13 shows an example of positioning control with changing wind.

FIG. 13 shows simulation results of the discretized controller of the invention with changing wind. The upper plot shows the position of the trolley, the middle plot shows speed of the trolley and lower plot shows the angle of the load. Position reference $s_{ref}$=25 m is given for the controller and the position reference is changed to a position profile in the manner described above. The simulated position follows the position profile accurately. In the simulation, the wind direction is first opposite to the trolley movement during time t=0 s . . . 7 s. The wind direction changes at time t=7 s . . . 8 s and during time t=8 s . . . 19 s the wind direction is the same as the direction of the trolley movement. Other parameters are L=5 m, m=50 kg, M=80 kg, $t_{acc}$=3 s and $v_t$=2 m/s. The simulation is carried out both with a reduced-order observer (ROOB) and full-order observer (FOOB). It is seen from the simulation results that the control action with the both observers is quite similar.

In the method of the invention a position reference for the movable structure is provided and the position of the movable structure is controlled with a state-feedback controller. The position of the movable structure and sway angle of the load are state variables of the system which is used in the state-feedback controller. Further in the invention, the position or the speed of the movable structure is determined. In the above described embodiments the position of the movable structure is described to be measured. According to an embodiment, the position of the movable structure can also be estimated by using the frequency converter driving the movable structure in a manner known as such. Similarly, in an embodiment, the speed of the movable structure can be estimated. The estimation of speed can be carried out by the frequency converter.

Further in the invention, the sway angle of the load or angular velocity of the load is determined. The determination of the angle or the velocity of the load is preferably carried out by direct measurement.

The determined values, i.e. position or speed of the movable structure and determined sway angle of the load or angular velocity of the load and the output of the state-feedback controller are used as an input to an observer in a manner described above in detail.

The observer produces at least two estimated state variables. The state variables include estimated position of the movable structure, estimated sway angle of the load, estimated speed of the movable structure and the estimated angular velocity of the load.

The estimated state variables are used for forming a feedback vector. Alternatively, the feedback vector is formed from estimated state variables together with determined state variables. The feedback vector is used as a feedback for the state-feedback controller and the output of the controller is fed to a frequency converter which drives the movable structure of the overhead crane.

The control arrangement of the present invention for positioning a movable structure of an overhead crane, which is either a trolley or a bridge of the crane, comprises means for providing a position reference for the movable structure. The means is preferably an input means which is operated by an operator or an operating system of the crane. The arrangement further comprises a state-feedback controller adapted to control the position of the movable structure, the position of the movable structure and a sway angle of the load being state variables of the system used in the state-feedback controller. Further, the arrangement comprises means for determining the position or speed of the movable structure and the sway angle of the load or angular velocity of the load. The position or the speed of the movable structure is preferably estimated using the frequency converter which is used as an actuator in the arrangement. Alternatively, the position or the speed are measured using sensors which are suitable for the measurement of the speed or position of the crane.

The arrangement also comprises means for providing the determined position or speed of the movable structure, the determined sway angle of the load or angular velocity of the load and the output of the state-feedback controller to an observer.

The observer is adapted to produce at least two estimated state variables, the estimated state variables including estimated position of the movable structure, estimated sway angle of the load, estimated speed of the movable structure and the estimated angular velocity of the load. The controller also comprises means for forming a feedback vector from the estimated state variables or from the estimated state variables together with determined state variables and means for using the formed feedback vector as a feedback for the state-feedback controller. Further, the arrangement comprises means for providing the output of the controller to a frequency converter which is adapted to drive the movable structure of the overhead crane.

The method of the invention can be implemented by a frequency converter which together with a motor acts as the actuator, i.e. drives the movable structure according to the output of the control system. Frequency converters comprise internal memory and processing capability for implementing the method. The position reference for the trolley is given by the operator or an operating system to the frequency converter, and the controller structure is implemented in the frequency converter. That is, the observer and the controller presented in the drawings are preferably implemented in a processor of a frequency converter which drives the trolley. The one or more feedback signals from the sensors are fed to the frequency converter for the desired operation.

As mentioned above, the invention is mainly described in connection with a trolley as a movable structure of a crane. However, the above described structure of the controller is directly applicable to control of the position of the bridge of an overhead crane.

It will be obvious to a person skilled in the art that, as the technology advances, the inventive concept can be implemented in various ways. The invention and its embodiments are not limited to the examples described above but may vary within the scope of the claims.

The invention claimed is:

1. A method of positioning a movable structure of an overhead crane, the movable structure being either a trolley or a bridge of the overhead crane, the method comprising providing a position reference for the movable structure, controlling with a state-feedback controller the position of the movable structure, the position of the movable structure and a sway angle of the load being state variables of the system used in the state-feedback controller, determining the position or speed of the movable structure and the sway angle of the load or angular velocity of the load, providing the determined position or speed of the movable structure, the determined sway angle of the load or angular velocity of the load and the output of the state-feedback controller to an observer, producing with the observer at least two estimated state variables, the estimated state variables including estimated position of the movable structure, estimated sway angle of the load, estimated speed of the movable structure and the estimated angular velocity of the load, forming a feedback vector from the estimated state variables or from the estimated state variables together with determined state variables, using the formed feedback vector as a feedback for the state-feedback controller, and providing the output of the controller to a frequency converter which is adapted to drive the movable structure of the overhead crane, wherein the determining the position or speed of the movable structure comprises estimating the position or the speed of movable structure, wherein the position or speed of the movable structure is estimated using the frequency converter.

2. The method according to claim 1, wherein the state variables of the system used in the state-feedback controller are the position of the movable structure, the speed of the movable structure, the sway angle of the load and the angular velocity of the load.

3. The method according to claim 1, wherein the observer is a full-order observer, and the forming of the feedback vector comprises forming the feedback vector from estimated state variables.

4. The method according to claim 1, wherein the observer is a reduced-order observer, and the forming of the feedback vector comprises forming the feedback vector from the determined sway angle of the load, determined position of the movable structure, the estimated angular velocity of the load and estimated speed of the movable structure.

5. The method according to claim 1, wherein the determining the position or speed of the movable structure comprises measuring the position or the speed of movable structure.

6. The method according to claim 1, wherein the frequency converter comprises a speed controller.

7. The method according to claim 1, wherein the output of the controller is a force reference, which is changed to a torque reference in the frequency converter.

8. The method according to claim 1, wherein the method comprises modifying the position reference at the input of the controller to a position profile, the position profile limiting the speed and the acceleration of the movable structure.

9. The method according to claim 2, wherein the observer is a full-order observer, and the forming of the feedback vector comprises forming the feedback vector from estimated state variables.

10. The method according to claim 2, wherein the observer is a reduced-order observer, and the forming of the feedback vector comprises forming the feedback vector from the determined sway angle of the load, determined position of the movable structure, the estimated angular velocity of the load and estimated speed of the movable structure.

11. The method according to claim 2, wherein the determining the position or speed of the movable structure comprises estimating the position or the speed of movable structure.

12. The method according to claim 3, wherein the determining the position or speed of the movable structure comprises estimating the position or the speed of movable structure.

13. The method according to claim 2, wherein the determining the position or speed of the movable structure comprises measuring the position or the speed of movable structure.

14. The method according to claim 3, wherein the determining the position or speed of the movable structure comprises measuring the position or the speed of movable structure.

15. The method according to claim 2, wherein the method comprises modifying the position reference at the input of the controller to a position profile, the position profile limiting the speed and the acceleration of the movable structure.

16. The method according to claim 3, wherein the method comprises modifying the position reference at the input of the controller to a position profile, the position profile limiting the speed and the acceleration of the movable structure.

17. The method according to claim 2, wherein the output of the controller is a force reference, which is changed to a torque reference in the frequency converter.

* * * * *